United States Patent [19]

Doty et al.

[11] Patent Number: 4,802,266

[45] Date of Patent: Feb. 7, 1989

[54] SEAT BELT BUCKLE

[75] Inventors: Gerald A. Doty, Crown Point, Ind.; James L. Zygutis, Frankfort, Ill.

[73] Assignee: Gateway Industries, Inc., Olympia Fields, Ill.

[21] Appl. No.: 45,954

[22] Filed: May 1, 1987

[51] Int. Cl.[4] ..... A44B 11/28

[52] U.S. Cl. ..... 24/637; 24/641

[58] Field of Search ..... 24/636, 637, 640, 641, 24/645, 651; 297/468; 280/801

[56] References Cited

U.S. PATENT DOCUMENTS

| | | | |
|---|---|---|---|
| 4,358,879 | 11/1982 | Magyar | 24/641 |
| 4,394,792 | 7/1983 | Schmidt | 24/637 |
| 4,451,958 | 6/1984 | Robben et al. | 24/636 |
| 4,454,634 | 6/1984 | Haglund et al. | 24/636 |
| 4,492,007 | 1/1985 | Tolfsen | 24/637 X |
| 4,527,317 | 7/1985 | Straszewski | 24/637 X |
| 4,543,693 | 10/1985 | Cunningham | 24/640 |
| 4,562,625 | 1/1986 | Doty et al. | 24/641 X |
| 4,624,034 | 11/1986 | Ishiguro et al. | 24/636 X |

*Primary Examiner*—Kenneth J. Dorner

*Assistant Examiner*—James R. Britton

*Attorney, Agent, or Firm*—Fitch, Even, Tabin & Flannery

[57] ABSTRACT

A seat belt buckle having a buckle frame and a pivotal latching member mounted therein includes an improved actuating system which locks the latching member and which assists in ejecting a tongue plate from the frame when the latch mechanism is in its open position. The actuating system includes a stirrup-like linkage including a cylindrical ejector member joined at each end to a pair of pivotally mounted arms. A locking cylinder also extends between the arms. A generally U-shaped retainer includes flat plate-like walls which are pinned to the pair of arms. The ejector member making up the central portion of the stirrup is mounted for sliding reciprocation in a slider member which is attached thereto with a snap-lock action. The slider member includes a sliding tail which reciprocates back and forth in the buckle frame. The actuating mechanism made up of the retainer member, stirrup-shaped linkage, and slider reduces friction and provides improved rigidity in the linkage which eliminates jamming of the mechanism throughout its range of motion.

7 Claims, 3 Drawing Sheets

27a
66
62
66
72
74
89
90
73
28
89
82
82
76
84
85
46
18
78
78
71
86
70
71
63
77
46
57
24a
24
63
112
34
112
108
110
111
120
116
113
94
102
103
98
106
88
48
64
68a
100
14
88
68a
109
115
114
68b
42
44
100
64
68b
42
40
94
22
36
38
12
29
27b
38
33

SEAT BELT BUCKLE

BACKGROUND OF THE INVENTION

The present invention relates generally to improvements in seat belt buckles, and more particularly to seat belt buckles which are suitable for use in motor vehicles.

A seat belt buckle provides a readily releasable mechanism for securing the ends of a seat belt and/or shoulder belt in a predetermined position to restrain an occupant of a vehicle during a collision.

One form of seat belt buckle in use particularly in Europe has a side operated push button rather than a top push button and employs a lock pin or latch bar which is positioned to block release of a latching pawl from locking engagement with a tongue plate until the push button is operated. Usually, the lock pin or bar is mounted to slide in slots in the frame and is shifted by movement of the push button from a blocking position over the latch pawl to a release position in which the latch pawl is free to pivot from latching engagement with the tongue plate. In such buckles, the push button is typically biased toward an outer position and is pushed inward to open the latch mechanism.

One example of a seat belt buckle is given in U.S. Pat. No. 4,562,625 issued Jan. 7, 1986 to Gerald A. Doty and William E. Hunter, of which the present invention is an improvement. One major feature of U.S. Pat. No. 4,562,625 is the single tension spring which is employed to perform various needed functions, such as biasing a latching member in both open and closed positions, as well as biasing a push button to its normal, outward extending position. While the seat belt buckle described therein has been very successful, certain refinements could lead to even greater cost savings, especially since seat belts of this kind are produced in large numbers for use as original equipment on automobiles. Even relatively minor savings in the cost of each unit, can make a substantial difference in the commercial success of the seat belt design.

Attention is directed herein to desired improvements which are principally concerned with the so-called actuating system which interconnects the single spring mentioned above, with a first member for ejecting a tongue plate from the seat belt latch, and a second member for locking a tongue-engaging latch. The actuation system includes a pair of rigid links which are fastened to the ends of a first cylindrical pin which locks the tongue-engaging latch. The links are also fastened to the ends of another cylindrical pin which ejects the tongue plate from the buckle.

The bottom portions of the rigid links and the ends of the cylindrical pin which ejects the tongue plate ride along slots formed in the latch frame. It is particularly desirable if any frictional forces generated between these members and the slotted latch frame could be reduced or eliminated.

Improved control over movement of the tongue plate ejecting pin, would be welcomed as an improvement in fail-safe operation of the seat belt buckle.

The actuation system of U.S. Pat. No. 4,562,625 further includes a wire-formed retainer having arms which extend outside the frame, between the frame and a plastic cover, for attachment to the rigid links. The retainer arms move back and forth, as they follow the links during operation of the seat belt buckle, in a relatively narrow gap formed between the frame and cover. If the retainer could be entirely contained within the frame, then the risk of jamming the retainer between the frame and cover would be reduced, particularly when a 40G load is applied to the side of the buckle as is done in some tests for automotive companies and/or governmental agencies. Additionally, this allows the frame to be made wider and more massive so that it may withstand heavier loads without increasing the width of the cover.

Further improvements could also be made if the wire-formed retainer could be replaced with a more rigid structure, to prevent warping during assembly or operation of the seat belt. A rigid structure would also offer improved pivotal support for the links, as opposed to L-shaped bends formed in the ends of the retainer member.

Any separate preassembly steps that can be eliminated can lead to considerable cost savings. In particular, it would be advantageous if construction of the link assembly could be simplified, or even formed of a single molded part.

SUMMARY OF THE INVENTION

Accordingly, it is the principle object of the present invention to provide an improved seat belt buckle which is comprised of a fewer number of inexpensive parts but which offers improved fail-safe operation.

It is another object of the present invention to provide a seat belt buckle having an improved actuation system which reduces friction of moving parts while increasing the strength and ease of assembly of those parts.

These and other objects and features of the present invention, which will become apparent from the following detailed description and the accompanying drawings, are provided in a seat belt buckle consisting of a tongue plate and a buckle frame with an opening at its forward end for receiving the tongue plate. A pivotal latching means, or pawl, is movable between a first position, for retaining the tongue plate within the buckle frame, and an open position for enabling the tongue plate to travel into and out of the buckle frame. Means for locking the latching mechanism in latching position include a movable transverse member extending across the width of the buckle adjacent the latching means and detent means defining a locked position and an unlocked position for the transverse member. A push button, movable between a first position and a second position, is operatively associated with the latching means for shifting the latching means from the latching position to the open position when the push button is moved from the first position to the second position. Ejection means include a generally cylindrical ejection pin extending transversely across the width of the buckle for urging the leading end of the tongue plate away from the buckle frame. Actuating means operatively associate the ejection pin with the transverse member to shift the latching means into latching position upon insertion of the tongue plate. Biasing means bias the transverse member toward the unlocked position when the latching means is in the open position and urge the transverse member into the locked position when the tongue plate is pushed into the buckle frame and the latching means is moved into the latching position. The biasing means include a coil spring loaded in tension, the spring having forward and rearward ends, and being attached at its forward end to the latching means to urge the latching means toward the open position. The actuating means include a stirrup-shaped linkage member having a generally cylindrical central portion comprising the ejection pin, and two arms, one at each end of the ejection pin. The transverse member also extends between the two arms so as to be spaced from the ejection pin, and there are pivot connecting means on the two arms intermediate the transverse member and the ejection pin. The actuating means further consist of a generally U-shaped retainer member including a bight portion extending between two legs, the legs of the U being pivotally attached to the pivot connecting means. The bight portion includes means for pivotal mounting to the frame and spring engaging means for engaging the rearward end of the spring.

BRIEF DESCRIPTION OF THE DRAWINGS

In the drawings, like reference numbers indicate like parts throughout.

DETAILED DESCRIPTION OF THE PREFERRED EMBODIMENT

In the following description, the buckle will be described in its illustrated orientation, and terms such as "upward" and "downward" will refer to directions relative to the illustrated orientation. It will be appreciated that this orientation has been selected merely for convenience of description, and that the buckle may assume any of various different orientations during use.

Figure 1:
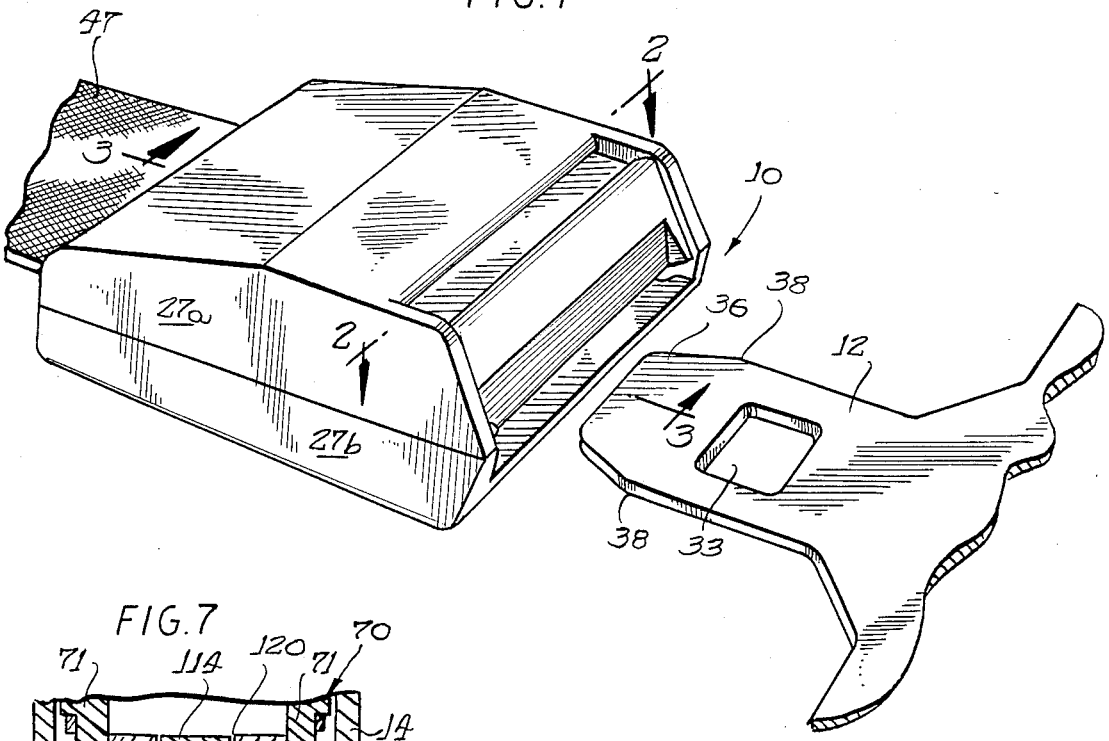
FIG. 1 is a perspective view of a seat belt buckle in accordance with the present invention.
Figure 7:
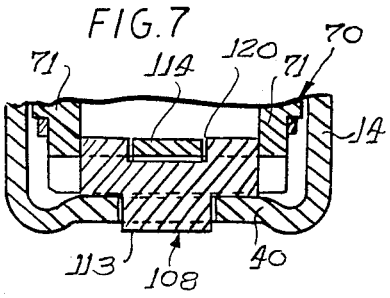
FIG. 7 is a partial sectional view taken substantially along line 7—7 of FIG. 2.

The present invention is generally embodied in a seat belt buckle 10 which includes a tongue plate 12 and a buckle frame 14 having an opening 16 at its forward end for receiving the tongue plate 12. Mounted within the buckle frame are pivotal latching means or pawl 18 movable between a latching position (FIG. 4) for retaining the tongue plate 12 within the buckle frame 14 and an open position (FIGS. 1-3) for enabling the tongue plate 12 to travel into and out of the buckle frame 14. The buckle 10 further includes a locking means 20 movable between a locked position for securing the pawl 18 in latching position and an unlocked position for enabling the pawl 18 to move between latching position and open position. A push button 22 shifts the pawl 18 from latching position to open position as the push button 22 is moved from a first, or outer position to a second, or inner position. Ejector means 24 urges the tongue plate 12 forwardly of the buckle 10 when the pawl 18 shifts to an open position. The movements of the various components are coordinated by actuator means 26.

The illustrated buckle 10 includes an exterior cover 27 which includes a top **27*a* and a bottom 27*b*. The bottom 27*b* has a flared opening 29 at its forward end to receive the tongue plate 12**.

Figure 4:
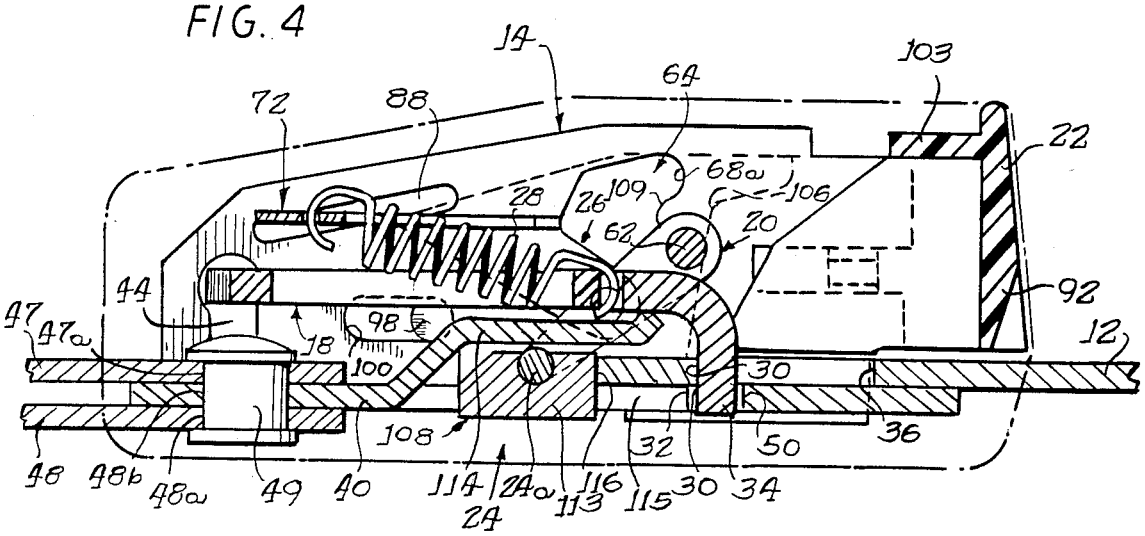
FIG. 4 is a longitudinal sectional elevational view similar to FIG. 3, but showing the tongue plate in a fully insert latched condition.

In accordance with the present invention, there is provided a compact, lightweight and inexpensive buckle of the side release type which is capable of withstanding tensile loads of up to about 5000 lbs. and which remains latched under such loads with a transverse locking member or pin 62 being positioned in blocking relationship to the pawl 18 when in latching position, as best seen in FIG. 4. As will be described herein, the pawl 18 is configured and related to the transverse member 62 so that is capable of withstanding these heavy loads despite its relatively small size and light weight.

A single spring 28 provides force to bias the push button 22 forward toward its outer position and ejection force to urge the tongue plate 12 forwardly of the frame 14 when the pawl 18 is in open position. The preferred spring 28 is a coil spring which is maintained in tension in an extended configuration. To avoid the possibility of the tongue plate 12 being retained within the buckle frame without the pawl 18 being locked in latching position, it is desirable that the locking means 20 automatically shift to locked position after insertion of the tongue plate 12. To this end, in the preferred embodiment of the present invention, the spring 28 additionally provides force to urge the locking means 20 toward its locked configuration (FIG. 4) after insertion of the tongue plate 12.

It will be appreciated that the pawl 18 must be held in an open position prior to insertion of the tongue plate 12 to enable insertion of the tongue plate 12. This is also accomplished in the illustrated embodiment by the spring 28. The spring 28 provides biasing force to maintain the pawl 18 in open position when the locking means 20 is in its unlocked position.

Turning now to a more detailed description of the illustrated embodiment of the present invention, the pawl 18 is pivotal between an upper or open position (FIG. 3) and a lower or latching position (FIG. 4). To retain the tongue plate 12 within the buckle frame, the pawl 18 includes a rearwardly facing surface 30 which is moved into engagement with a forwardly facing surface 32 of the tongue plate 12 when the tongue plate is inserted into the buckle frame 14. In the illustrated embodiment, the rearwardly facing surface 30 is formed on a downwardly extending dog or tooth 34 at the forward end of the pawl 18, and the forwardly facing surface 32 is formed in an opening 33 formed generally centrally through the tongue plate 12 which receives the tooth 34 of the pawl 18. The tongue plate 12 has a tapered leading end 36 with rounded corners 38 (FIG. 1) to facilitate its insertion into the buckle frame 14.

The buckle frame 14 herein includes a bottom wall 40 and a pair of upstanding side walls 42. The outer surfaces of sidewalls 42 are identified by the reference numeral **42*a*. To pivotally support the pawl 18 on the buckle frame 14, openings 44 are provided near the rear end of each sidewall 42 to accommodate ears 46 extending outwardly on opposite sides of the rearward end of the pawl 18. The pawl is mounted by tilting for easy reception into the elongated bottom portion of opening 44. The pawl is then released, whereby ears 46 are positioned in the enlarged upper portions of opening 44**.

To secure the frame 14 of the buckle 10 to a support on the interior of a vehicle, means such as the illustrated straps 47 and 48 are provided. The straps 47 and 48 are preferably made of martensite steel to provide a high tensile strength member to resist the high tensile loads which may break similar members of ordinary steel. Generally circular openings 47*a* and 48*a* are formed through the straps and aligned with a corresponding opening 48*b* in the bottom wall 40 of the frame 14 so that a fastener, such as the illustrated rivet 49 passing through the aligned openings 47*a*, 48*a* and 48*b*, may be employed to secure the frame 14 to the straps 47 and 48.

When a tensile force is applied to the tongue plate 12 tending to pull it out of the interior of the buckle frame 14, as during a collision, the force is transmitted to the pawl 18, tending to pull the pawl forwardly of the buckle 10 and tending to deform the pawl. To enable the buckle 10 to withstand relatively high forces without failing, means are provided for retaining the pawl within the buckle frame 14 and supporting it against excessive deformation.

In the illustrated embodiment, the pivotal engagement of the ears 46 of the pawl in the openings 44 in the side walls 42 of the frame 14 provides support for the pawl 18 at its rearward end. When in its lower or latching position, the pawl 18 is further supported at its forward end by a rearwardly facing surface 50 formed at the forward end of an opening 52 in the bottom wall 40 of the frame 14. This surface 50 is normally spaced from a forward surface 54 of the pawl tooth 34 by a small distance, but when excessive tensile force is applied to the buckle 10, the pawl 18 deforms so that the forward surface 54 of the pawl tooth 34 can move into abutting engagement with the rearwardly facing surface 50 and thereby be constrained against further forward movement. Thus, this engagement both constrains the pawl 18 from moving forwardly and constrains the tooth 34 against bending forwardly and upwardly.

The deformation of the pawl 18 to enable contact between the tooth 34 and the rearwardly facing surface 50 may include both bending of the tooth and elongation of the remainder of the pawl. It is desirable that the deformation be elastic so that after application of an impact load, the pawl 18 returns to its original configuration so that the buckle continues to operate properly. To this end, the pawl may have a bend (not shown) formed in it adjacent a generally rectangular central opening 57 which would enable elastic elongation of the pawl 18 under tension. That is, the transverse bend will tend to straighten under high tension loading and allow the pawl body to elongate slightly to allow the tooth surface 54 to abut the frame surface 50.

The leading end 36 of the tongue plate 12 engages the ejector means 24 (which includes a slide block 108 in which is journaled an ejector pin 24) as the leading end 36 is inserted into the buckle 10. The illustrated ejector pin 24*a* is an elongated cylindrical pin or member which extends across the width of the buckle frame 14.

The locking means 20 herein comprises a transverse member or locking pin 62 which extends across the top of the pawl 18, and a detent means 64 defining an unlocked position and a locked position for the transverse member 62. In the locked position, the detent means 64 constrain the locking pin 62 against upward movement, and the locking pin 62 constrains the pawl 18 against upward movement. The detent means 64 in the illustrated embodiment comprise a pair of openings 64, one formed through each of the side walls 42 of the frame 14, which engage respective opposite ends 66 of the locking pin 62. Each opening defines a curved surface 68 against which the locking pin 62 is urged. The curved surface includes two adjacent curved detents 68*a* and 68*b* for the locked and unlocked positions respectively.

To automatically shift the pawl 18 to latching position upon insertion of the tongue plate 12, the ejector means 24 is interconnected with the locking pin 62 herein by actuator means 26 which pull the locking pin 62 downwardly as the ejector means 24 is pushed rearwardly by the leading end 36 of the tongue plate 12 as the tongue plate 12 travels rearwardly into the buckle frame 14. The actuator means 26 herein include stirrup-like linkage means 70 comprising a generally cylindrical central portion which comprises ejector pin 24*a*. The central portion extends between two link-shaped arms 71. Preferably, ejector pin 24*a* and arms 71 are integrally formed of die-cast metal, such as zinc.

The actuator means 26 further includes a three-walled, generally U-shaped connector member or retainer 72 which includes a generally flat plate containing a bight portion 73. The flat plate is joined on opposite edges to flat plate-like side walls 84 which are pivotally connected to the linkage means 70. The flat plate also extends rearwardly from the arms 71 to the rearward end 74 of the spring 28. The forward end 76 of the spring 28 is curved into a generally hook-shaped configuration and is attached to the pawl 18 near its forward end. To facilitate this attachment, an opening 77 (FIG. 2) is provided in the pawl 18 near its forward end to receive the forward end 76 of the spring 28. A similar opening 90 is formed in bight portion 73 to receive the rearward end 74 of spring 28.

Figure 2:
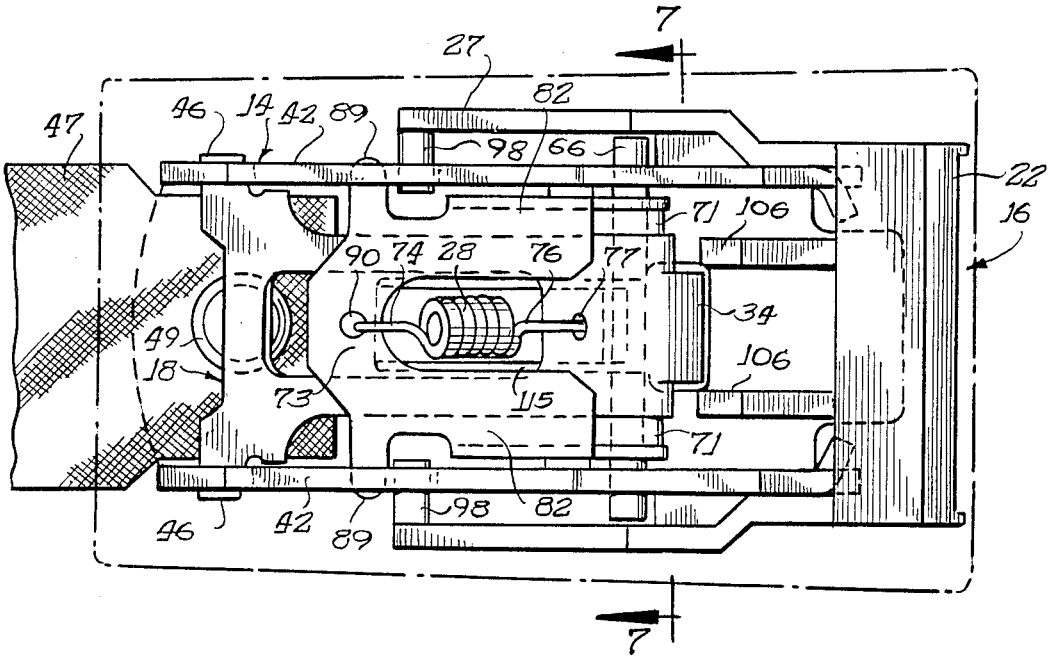
FIG. 2 is a plan view of the interior of the buckle of FIG. 1, taken substantially along line 2—2 in FIG. 1.

The locking pin 62 is preferably generally cylindrical so as to fit through generally circular apertures 78 near the upper ends of the respective link-shaped arms 71. The retainer 72 preferably has three integrally-formed walls including the bight portion or medial wall 73, legs 82 and flat plate-like depending side walls 84. Each side wall 84 has an aperture 85 for receiving outwardly-extending pivot connecting means or lugs 86 integrally formed with arms 71 of linkage means 70. To guide the retainer 72 as it travels, guide slots 88 are formed in the side walls 42 of the frame 14 and the bight portion 73 of the retainer 72 includes outward ears 89 which extend through the slots 88. As can be seen in FIG. 2, the mounting ears 89 have free ends 89*a* which preferably do not extend beyond the outer surfaces 42*a* of the sidewalls 42 of buckle frame 14. The mounting ears 89 could, of course, extend slight amounts beyond the outer surfaces of the sidewall exterior surfaces 42*a*, if desired.

Figure 3:
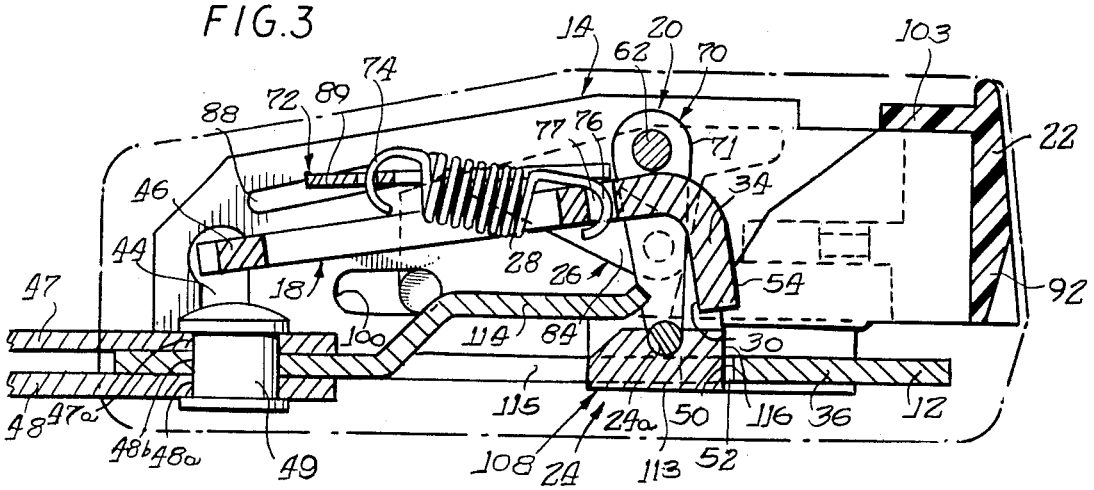
FIG. 3 is a longitudinal sectional elevational view of the buckle of FIG. 1 taken substantially along lines 3—3 in FIG. 1 and looking in the direction of the arrows.

The buckle 10 is shown in FIG. 3 with the pawl 18 in open position for receiving the tongue plate 12. In the open position, the ejector means 24 is located below and slightly forward of the locking pin 62. In this position, the tension on the spring 28 acts through the retainer 72 to urge the linkage means 70 forwardly. The locking pin 62 is constrained against forward movement by the detent means 64 formed in the side walls 42 of the frame 14. Thus, the force exerted on the linkage means 70 by the retainer 72 tends to pivot the linkage means 70 in a counterclockwise direction, urging the ejector means 24 forward.

The push button 22 herein preferably has a front wall 92 which is generally smooth and attractive for engagement by the fingers of the user, a pair of side walls 94 extending rearwardly therefrom, and a camming means 106 for engagement with the ejection means 24 as described in further detail below. Each of the side walls 94 has an inwardly extending lug 98 formed on it to engage an elongated slot 100 in an adjacent side wall 42 of the buckle frame 14 to retain the push button on the frame. Additionally, each of the side walls 94 has a camming surface 102 formed on its inner surface for engaging the locking pin 62 as also described below.

In the position illustrated in FIG. 3, the rearward, inwardly extending lugs 98 on the push button 22 are at the forward ends of their respective associated slots 100 in the side walls 42 of the frame 14. Also, the ears 89 of the retainer 72 is at or near the forward ends of the slots 88 through which they pass.

Figure 5:
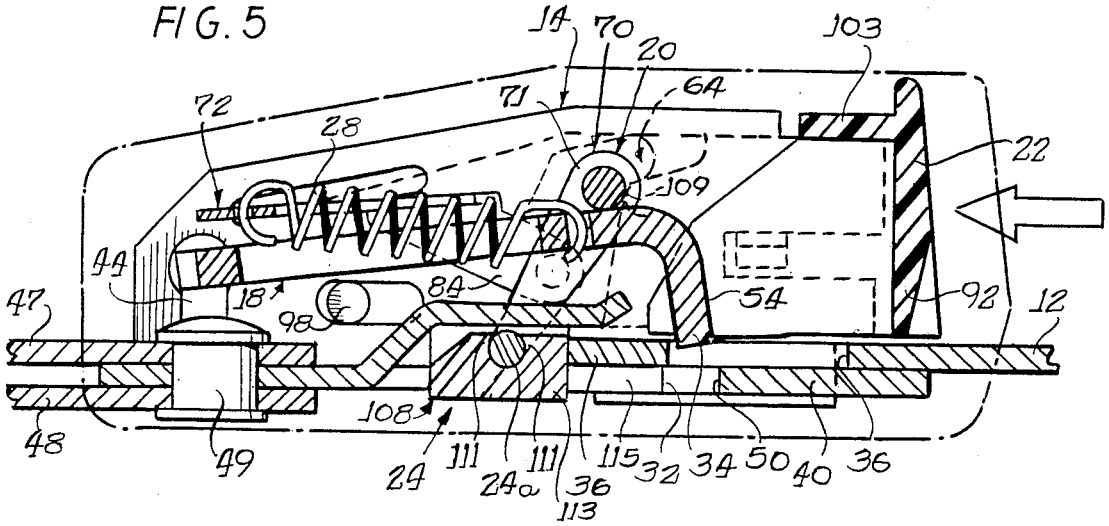
FIG. 5 is a longitudinal sectional elevational view similar to FIGS. 3 and 4 showing an unlatched condition of the seat belt buckle immediately prior to ejection of the plate therefrom.

Referring now to FIGS. 3–5, an arrangement is provided for reducing the friction between ejector pin 24*a*, and arms 71 as the actuator means 26 of the present invention reciprocates back and forth during seat belt buckle operation. A block-like slide member 108 is elongated in the direction of ejector means 24 and includes a pivot seat or trough 110 to receive the ejector pin 24*a*. Resilient retaining fingers 111 partially block an upper opening 112 providing access to trough 110. Fingers 111 are resiliently deflectable by ejector pin 24*a* as it is received in trough 110. The retaining fingers thereafter resume their normal relaxed configuration overlying ejector means 24 preventing its removal from trough 110. There is thereby provided a snap-lock pivotal seating engagement between ejector member 24*a* and slide member 108.

Slide 108 further includes a central rail-like member 113 which is elongated in the direction of mechanism reciprocation during seat belt operation. Rail 113 is dimensioned to be received in the central elongated slot 115 formed in the bottom wall 40 of frame 16. As the ejector means 24 of stirrup-like linkage means 70 reciprocates in forward and rearward directions during seat belt operations, the cylindrical ejector member pivots or journals in trough 110 and does not engage other seat belt mechanism members, particularly frame 16, with a sliding friction. Rather, this sliding friction is experienced solely by slide 108 which may be readily molded of a plastic material, for example, which reduces friction. Thus, the stirrup-like linkage means 70 and slide member 108 need not be formed of the same material. Further, with the slide of the present invention, the arms 71 of the linkage means also do not contact other portions of the seat belt mechanism.

Figure 6:
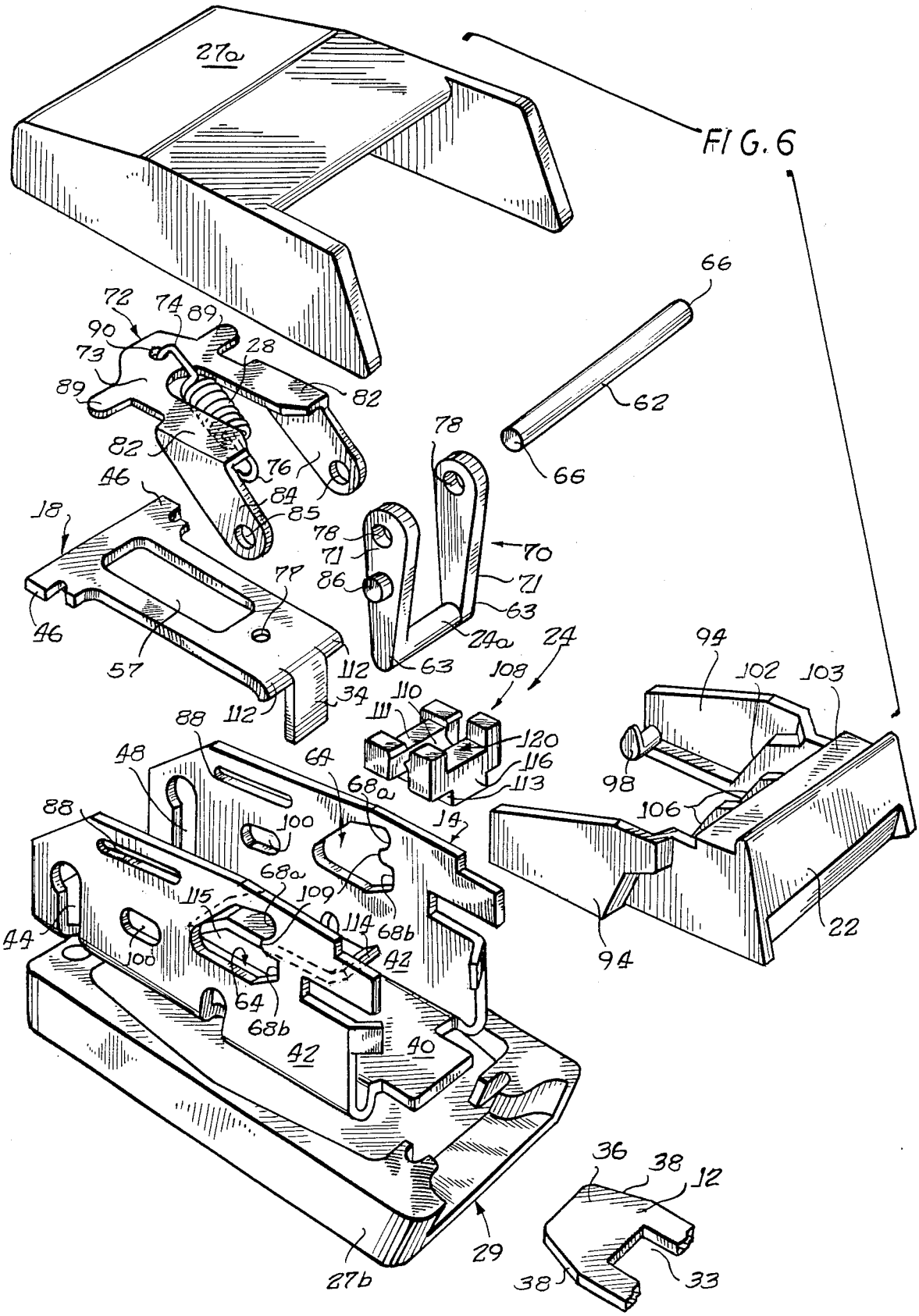
FIG. 6 is an exploded view of the seat belt buckle according to the preceding figures.

An additional feature of block member 108, seen most clearly in FIG. 6, is its tongue-receiving groove 120 generally coextensive with rail member 113, but located on the opposite, top side of the block member. Groove 120 receives a tongue or retaining finger 114 struck out of the bottom wall 40 of frame 14, during formation of slot 115. Tongue 114, in a close-fitting engagement with the channel 120, further controls any sideways displacement or misaligning torque experienced by block member 108, in addition to preventing an upward dislocation of ejector means 24 from slot 115. Those skilled in the art will readily appreciate the improved control of motion of ejector means 24 due to the mutually orthogonal elongated configurations of trough 110 and rail 113. Another feature of slide member 108 is its forward or leading surface 116 which provides contact with the leading end 36 of the tongue plate 12. It is this contact which transmits the spring force to push button 22 after its depression, which returns the push button to its normal, extended position (see FIG. 3).

Turning now to a description of the operation of the buckle of the preferred embodiment, when the tongue plate 12 is inserted into the buckle frame 14, its leading end 36 engages surface 116 of the guide block 108 and pushes the guide block 108 which carries the ejector pin 24*a* rearwardly, pivoting the linkage means 70 clockwise in opposition to the biasing provided by the spring 28. The ears 89 of the retainer 72 travels rearwardly while guided by the slots 88 in the side walls 42 of the frame 12. This extends the spring 28 so that the force exerted by the spring 28 on the linkage means 70 progressively increases. As the ejector pin 24*a* is pushed rearwardly, and the top of linkage means 70 is urged forwardly by the spring force acting through the retainer 72, the locking pin 62 is pulled downwardly along the curved surfaces 68 of defined by the detent means 64 formed in the side walls of the frame. As the locking pin 62 travels downwardly, it pushes the pawl 18 downwardly into the latching position wherein the pawl tooth 34 extends through the opening 33 in the tongue plate 12 and into the opening 52 in the bottom wall 40 of the frame 14. When the pawl 18 reaches its latching position, as shown in FIG. 4, the locking pin 62 is moved into the locking position by the force of the spring 28 transmitted through the linkage means 70 and through the retainer 72.

It will be appreciated that when the pawl 18 is in its latched position as illustrated in FIG. 4, the tongue plate 12 may not be withdrawn from the interior of the buckle frame 14 without structural failure of some component of the buckle 10.

To open the pawl 18 and permit withdrawal of the tongue plate 12, the push button 22 is pushed inwardly to the position illustrated in FIG. 5. As the push button 22 travels inwardly, it displaces the locking pin 62 rearwardly to the point 109 where it is no longer constrained against upward movement by the detent means 64. This displacement is accomplished by the engagement of the camming surfaces 102 on the push button 22 with the opposite ends 66 of the locking pin 62. The camming surfaces 102 herein are inclined so as to urge the locking pin 62 upwardly as well as rearwardly. Under conditions of low tension or no tension on the buckle 10, once the locking pin 62 reaches this point 109, the spring force pulls the pawl 18 to open position. The push button includes a horizontal top wall or cap 103 which is integral with the remainder of the push button rather than being a separate molded piece as in U.S. Pat. No. 4,562,625.

If there is a considerable amount of tension on the buckle 10, the spring force alone may be insufficient to pull the pawl 18 to open position upon the locking pin 62 reaching this point 109. Accordingly, camming means 106 are provided on the push button to enable the pawl 18 to be shifted from latching position to open position by manual effort. In the illustrated embodiment, the push button camming means 106 has a pair of camming surfaces which engage shoulders 112 on the pawl 18 to push it upwardly as the push button 22 is pushed inwardly. Once the locking pin 62 has traveled upward beyond the point 109, it is urged by the spring force into the detent 68*a* corresponding to the unlocked position.

As the pawl 18 is lifted, it is desirable that the tongue plate be prevented from moving in an upward direction. As mentioned above, this is accomplished by tongue 114 which is integrally formed with the frame 14, which enables the pawl 18 to be "stripped" from the tongue plate 12. Once the pawl 18 is in open position, the tongue plate 12 is free to move forwardly, out of the buckle frame 14. To eject the tongue plate 12 in this direction, the leading surface 116 of block member 108 engages the leading end 36 of the tongue plate 12 as shown in FIG. 5 and ejects the tongue plate from the buckle as the slide block travels forwardly to the position shown in FIG. 3. As the ejector means 24 travels forwardly, slide block 108 engages the surfaces of camming means 106 on the push button 22 to return the push button 22 to its outer position, returning the buckle 10 to the configuration illustrated in FIG. 3.

From the foregoing, it will be appreciated that the present invention provides an actuating means having a number of improved features. Since the retainer member is completely contained within the frame 14, the retainer will not be injured when a 40 G load is applied to the cover side wall. The frame is wider and more massive than the frame disclosed in U.S. Pat. No. 4,562,625 to enable the withstanding of greater loads without increasing the size of the cover. Retainer 72 also provides improved rigidity against twisting, warping, or the like deformation which might possibly affect smooth operation of the seat belt. This is accomplished by forming retainer 72 of a flat plate bight portion, with depending flat plate-like walls 84 joined to the legs 82 of the flat plate. This construction also provides improved support at the pivotal connection between retainer 72 and stirrup-like linkage means 70.

The adjacent flat plate-like walls 84 and 71 of those pivotally interconnected members provides improved control over linkage motion during operation of the seat belt buckle, thereby substantially reducing the possibility of buckling or binding of the linkage during operation. The slide member 108 reduces friction and assists in ejecting the tongue plate while providing improved control of the linkage throughout its range of motion.

Also, the leading end 116 of slide 108 provides an engagement with tongue plate 114 that is more stable than the lengthwise engagement of a cylinder side wall, and the body of slide 108 more uniformly distributes forces imparted by the tongue plate over substantially the entire length of the ejector means 24 to which the slide is pivotally connected. Various other features leading to ease of assembly and a reduced number of operating parts are also attained by the present invention.

While a preferred embodiment 10 of the invention has been illustrated and described above, there is no intent to limit the scope of the invention to this or any other specific embodiment. The scope of the invention is defined by the spirit and language of the appended claims.

What is claimed is:

1. A seat belt buckle comprising:

a tongue plate;

a cover;

a buckle frame disposed within the cover and having a pair of upstanding parallel sidewalls and an opening at its forward end for receiving the tongue plate;

pivotal latching means movable between a latching position for retaining the tongue plate within the buckle frame and an open position for enabling the tongue plate to travel into and out of the buckle frame;

locking means for locking the latching means in latching position including a movable transverse member extending across the width of the buckle adjacent the latching means and detent means defining a locked position and an unlocked position for the transverse member;

a push button movable between a first position and a second position and operatively associated with the latching means for shifting the latching means from the latching position to the open position when the push button is moved from the first position to the second position;

ejection means including a generally cylindrical ejection pin extending transversely across the width of the buckle for urging the leading end of the tongue plate away from said buckle frame;

actuating means operatively associating the ejection pin with the transverse member to shift the latching means into latching position upon insertion of the tongue plate;

biasing means to bias the transverse member toward the unlocked position when the latching means is in the open position and to urge the transverse member into the locked position when the tongue plate is pushed into the buckle frame and the latching means is moved into the latching position, said biasing means including a single coil spring loaded in tension, said spring having forward and rearward ends, the spring being attached at its forward end to the latching means to urge the latching means toward the open position; and said actuating means including a stirrup-shaped linkage member disposed within the buckle frame sidewalls so as to be protected thereby, said linkage member having a generally cylindrical central portion comprising said ejection pin, and two arms, one at each end of said ejection pin, said transverse member also extending between said two arms so as to be spaced from said ejection pin, and pivot connecting means on said two arms intermediate said transverse member and said ejection pin, said actuating means further comprising a generally U-shaped retainer member disposed within the buckle frame sidewalls so as to be protected thereby, including a bight portion extending between two legs, said legs of the U pivotally attached to said pivot connecting means, and said retainer members including a pair of opposed mounting ears attached to said bight portion, one adjacent each leg, for mounting to said frame sidewalls for pivotal and sliding movement of the retainer member relative thereto, and spring engaging means for engaging the rearward end of said spring.

2. The seat belt buckle of claim 1 wherein said actuating means further comprises a slide member having first means for slidable engagement with said frame and second means for pivotal engagement with said ejection pin.

3. The seat belt buckle of claim 2 wherein said pivotal engagement means of said slide comprises a body defining an elongated t rough having an opening to receive said ejection pin, and at least one resilient retaining finger at least partially blocking said trough opening, said retaining finger being resiliently deflectable to allow entry of said ejection pin in said trough, and which at least partially blocks said opening after said entry to hold said ejection pin captive in said trough.

4. The seat belt buckle of claim 2 wherein said slidable engagement means of said slide member is received in an elongated slot of said frame for reciprocation therein, and is elongated in the direction of movement of said ejection pin to prevent twisting deflection of said retainer bight member during reciprocation.

5. The seat belt buckle of claim 2 wherein said slide member includes a forward surface engageable with said leading end of said tongue plate.

6. The seat belt buckle of claim 1 wherein said retainer member legs define pin-receiving apertures and said pivot connecting means of said arms includes outwardly-extending pins engageable in apertures formed in said legs of said retainer member.

7. The seat belt buckle of claim 6 wherein said retainer member comprises a flat plate containing said bight portion, said legs comprising side walls extending from opposed edges of said flat plate and defining said aperture for receiving said outwardly extending pins.

* * * * *